US005288042A

United States Patent [19]

Grimm

[11] Patent Number: 5,288,042

[45] Date of Patent: Feb. 22, 1994

[54] WRIST REST SUPPORT SYSTEM

[75] Inventor: Thomas M. Grimm, Robbinsdale, Minn.

[73] Assignee: Ergodyne Corporation, St. Paul, Minn.

[21] Appl. No.: 928,998

[22] Filed: Aug. 12, 1992

[51] Int. Cl.[5] ..... B43L 15/00

[52] U.S. Cl. ..... 248/118; 248/918; 248/231.7

[58] Field of Search ..... 248/118, 118.1, 118.3, 248/118.5, 918, 202.1, 231.7; 400/415, 417, 418

[56] References Cited

U.S. PATENT DOCUMENTS

| | | | |
|---|---|---|---|
| 1,189,098 | 6/1916 | Hall | 248/231.7 |
| 1,516,795 | 11/1924 | Schwarting | 248/118 X |
| 1,644,441 | 10/1927 | O'Brien | 248/118.1 |
| 2,477,898 | 8/1949 | Rehman et al. | 248/118 |
| 2,551,157 | 5/1951 | Price | 248/231.7 X |
| 2,709,563 | 5/1955 | Starkey | 248/231.7 X |
| 4,106,737 | 8/1978 | Arnett | 248/231.7 |
| 4,838,504 | 6/1989 | Bittenbinder | 248/223.4 X |
| 4,993,785 | 2/1991 | Dunand | 248/223.4 X |
| 5,022,622 | 6/1991 | Schaevitz | 248/118 |
| 5,088,668 | 2/1992 | Grimm | 248/118.3 |

FOREIGN PATENT DOCUMENTS

| | | | |
|---|---|---|---|
| 2833398 | 2/1980 | Fed. Rep. of Germany | 248/231.7 |
| 4569 | 4/1893 | Sweden | 248/118.1 |
| 403559 | 6/1966 | Switzerland | 248/231.7 |
| 9114384 | 10/1991 | World Int. Prop. O. | 248/118 |

*Primary Examiner*—Karen J. Chotkowski

*Attorney, Agent, or Firm*—Merchant, Gould, Smith, Edell, Welter & Schmidt

[57] ABSTRACT

A wrist rest support system for supporting a wrist rest beyond the edge of a working surface, including an extension clamp having a cantilever plate having a first end member proximate the working surface and a second end member, the second end member having a distal end cantilevered away from the working surface. Each end member has a separate longitudinal axis spaced laterally apart. The longitudinal axes are approximately parallel. A fastener for attaching the cantilevered plate to the working surface is connected to the first end member of the cantilever plate. The second end of the cantilever plate has a groove proximately perpendicular to the second axis. The groove is for receiving a sculpted portion of a base member of the wrist rest. A retaining member is disposed upwardly at the distal end of the second end member. The retaining member is for retaining the wrist rest on the second end member.

5 Claims, 3 Drawing Sheets

WRIST REST SUPPORT SYSTEM

FIELD OF THE INVENTION

This invention relates generally to a wrist rest system for use in confined working spaces.

BACKGROUND OF THE INVENTION

Wrist rests are well known in the art. Wrist rests can be used for a variety of purposes, but one of the most common is for operating a keyboard. While operating a keyboard, a person's wrists are generally unsupported. If this activity is continued for a long period of time, injuries such as carpal tunnel syndrome may result. The wrist rest encourages the user to maintain a neutral wrist position. Often, however, working surfaces or spaces are not large enough to accommodate the wrist rest.

The present invention addresses this problem with the prior art and provides for a wrist rest support system which is easily adjustable to accommodate a variety of working surfaces and spaces.

SUMMARY OF THE INVENTION

The present invention is a wrist rest support system including an extension clamp for supporting a wrist rest beyond the edge of a working space. The extension clamp comprises a cantilever plate having a first end member proximate the working surface and a second end member, having a distal end, cantilevered away from the working surface. Each end member has a separate longitudinal axis. The axis of the first end member is laterally spaced from the axis of the second end member, and the axes are approximately parallel.

A fastener is operably connected to the first end member of the cantilever plate for attaching the cantilever plate to the working surface. The second end of the cantilever plate has a groove approximately perpendicular to the second axis. The groove is for receiving a portion of the wrist rest. Disposed upwardly at the distal end of the second end member is a retaining member for retaining the wrist rest on the second end member.

DETAILED DESCRIPTION OF THE PREFERRED EMBODIMENT

Figure 1:
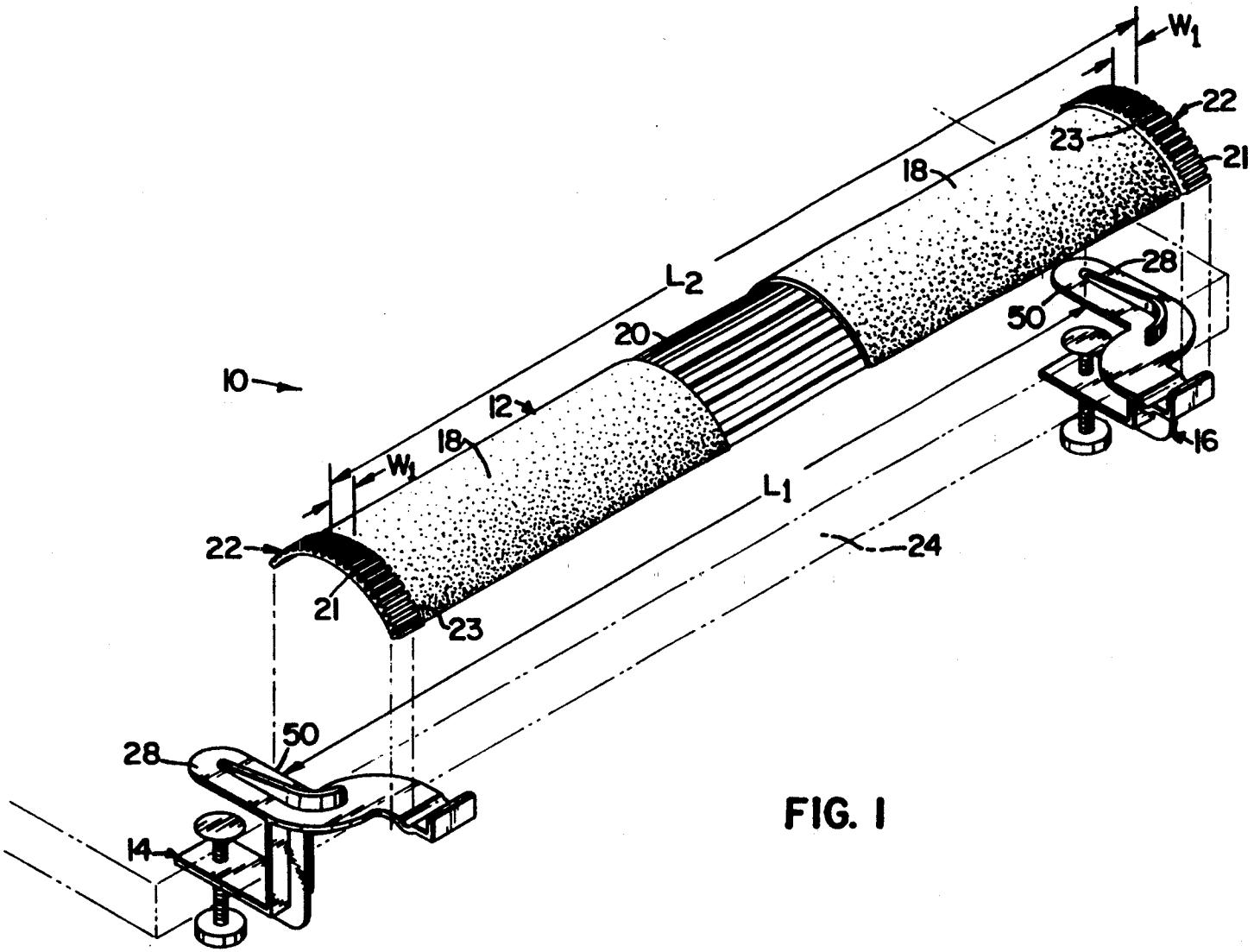
FIG. 1 shows a perspective view of the wrist rest support system including two extension clamps and a wrist rest.

Referring now to the drawings, wherein like reference numerals indicate like parts throughout the several views, there is a wrist rest support system y designated 10 in FIG. 1. The wrist rest support system includes a wrist rest 12 and a left hand extension clamp 14 and a right hand extension clamp 16. In FIG. 1 clamps 14 and 16 are shown attached to a working surface 24.

Several embodiments of the wrist rest 12 are described in U.S. Pat. No. 5,088,668 to Grimm issued Feb. 18, 1992 which is incorporated here by reference. As shown in FIG. 1, wrist rest 12 includes two arcuate support sections 18 operably connected to a arcuate base member 20 by a locking means.

Operably connected to support sections 18 proximate opposite ends of wrist rest 12 are end caps 22 having a distal end 21 and an inner side 23. End caps 22 have a width $W_1$. End caps 22 are also arcuate in shape to conform to the arcuate shape of support sections 18. End caps 22 have a cavity which is approximately the same size as the end of support sections 18. Opposite ends of section 18 proximate opposite ends of rest 12 are pushed into the cavity in end caps 22. The cavity is sized so that slight pressure is needed to insert the end caps into the cavity to create a friction fit.

Clamps 14 and 16 each have a first end member 28 having a second side 50. The distance between the second side 50 of clamp 14 and the second side 50 of claim 16 is $L_1$. The overall length of wrist rest 12 is $L_2$.

Figure 2:
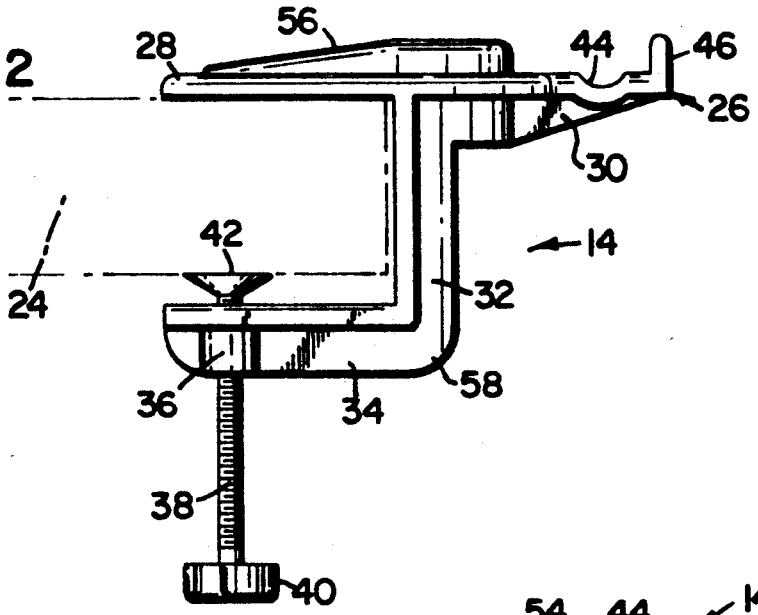
FIG. 2 shows a side view of a left hand extension clamp.

FIG. 2 shows a side view of left hand extension clamp 14. Left hand extension clamp 14 is a mirror image of right hand extension clamp 16. Thus, in the following discussion, for convenience, only left hand extension clamp 14 is described in detail. It is to be understood, however, that right hand extension clamp 16 is the same as left hand extension clamp 14, except for the positional differences inherent in a mirror image. As shown in FIG. 2, clamp 14 has a cantilever plate 26. Cantilever plate 26 includes the first end member 28 and a second end member 30.

Extending from first end member 28 is a means for fastening the cantilever plate to working surface 24. The fastening means including a vertical member 32 having a first end and a second end, the first end being operably connected to first end member 28 of extension clamp 14. The fastening means also includes a horizontal member 34 having a first end and a second end, the first end being operably connected to vertical member 32 proximate the second end of vertical member 32. Proximate the second and distal end of horizontal member 34 is an internally threaded bushing 36 for threadably receiving clamp screw 38. Proximate a first and lower end of clamp screw 38 is knob 40 and connected to the second and opposite end of clamp screw 38 is pivot plate 42. The operation and construction of pivot plate 42 is well known to those skilled in the art.

Also shown in FIG. 2, is a groove 44 proximate the distal end of second end member 30 of clamp 14. Operably connected to the distal end of second end member 30 is an upwardly disposed retaining member 46. Except for clamp screw 38, clamp 14 is preferably one-piece, injection molded, glass-filled nylon.

Figure 3:
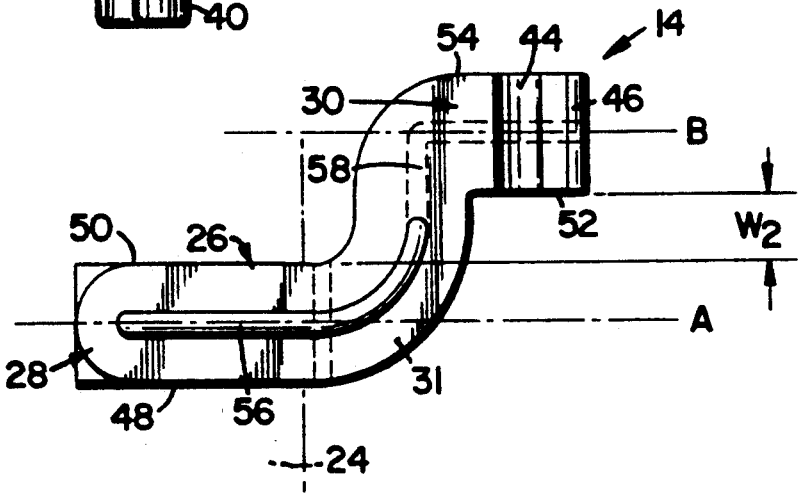
FIG. 3 shows a top view of a left hand extension clamp.

FIG. 3 shows a top view of the left hand extension clamp 14 attached to working surface 24. First end member 28 has a longitudinal axis A and second end member 30 has approximately parallel axis B laterally spaced from axis A of first end member 28. Between first end member 28 and second end member 30 is a S-shaped transition section 31 of cantilever plate 26.

A first side 48 and the second side 50 of end member 28 are oppositely disposed on either side of axis A. Side 48 and 50 are approximately parallel to axis A. A first side 52 and a second side 54 of second end member 30 are oppositely disposed on either side of axis B. Sides 52 and 54 are approximately parallel axis B. Second side 50 of first end member 28 is laterally spaced from first side 52 of second end member 30 by a distance of $W_2$.

In FIG. 3, groove 44 is shown approximately perpendicular to axis B. Retaining member 46 is approximately parallel to groove 44.

Clamp 14 has an upper rib 56 and a lower rib 58. Upper rib 56 is disposed upwardly away from cantilever plate 26. It extends from proximate the distal end of first end member 28 to proximate a line extending across the cantilever plate 26 coincident with first side 52 of second end member 30. Lower rib 58 is disposed below cantilever plate 26. Lower rib 58 extends from the distal end of second end member 30 to vertical member 32 of the fastening means. From there, lower rib 58 extends downward to horizontal member 34 of the fastening means and from there continues to the distal end of horizontal member 34. Ribs 56 and 58 provide rigidity and strength to clamp 14.

Figure 4:
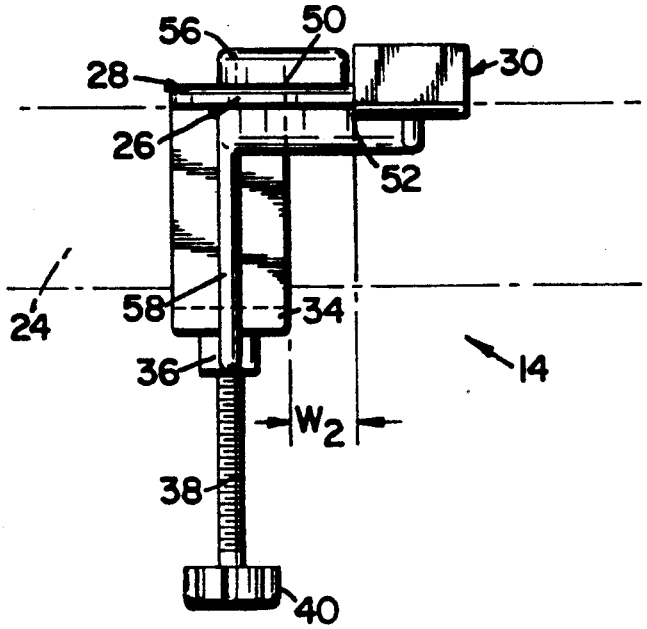
FIG. 4 shows a front view of a left hand extension clamp.

FIG. 4 shows a front view of left hand extension clamp 14 attached to working surface 24. First side 52 of second end member 30 of cantilever plate 26 is shown laterally spaced a distance $W_2$ from second side 50 of first end member 28 of cantilever plate 26. Upper rib 56 is shown disposed upwardly from cantilever plate 26 and lower rib 58 is shown disposed below cantilever plate 26. Clamp screw 38 having knob 40 is shown extending downward from internally threaded bushing 36 of horizontal member 34 of the fastening means.

Figure 5:
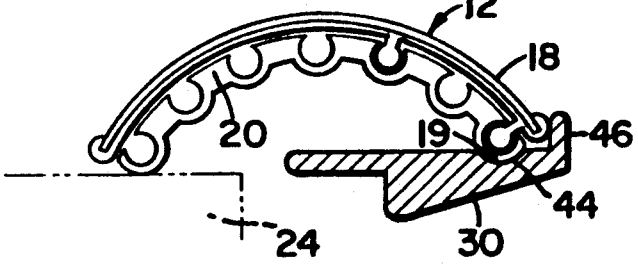
FIG. 5 shows a cross-section of the left hand extension clamp and wrist rest taken along the longitudinal axis of a second end member.

FIG. 5 shows a cross section through second end member 30 of clamp 14 taken along axis B. Also shown is a cross section of a typical wrist rest 12 taken along axis B. Support section 18 is shown above base member 20. Proximate one end of base member 20 is a sculptured portion 19. Sculpted portion 19 of base 20 is shown resting in groove 44 of second end 30 proximate retaining member 46.

Figure 6:
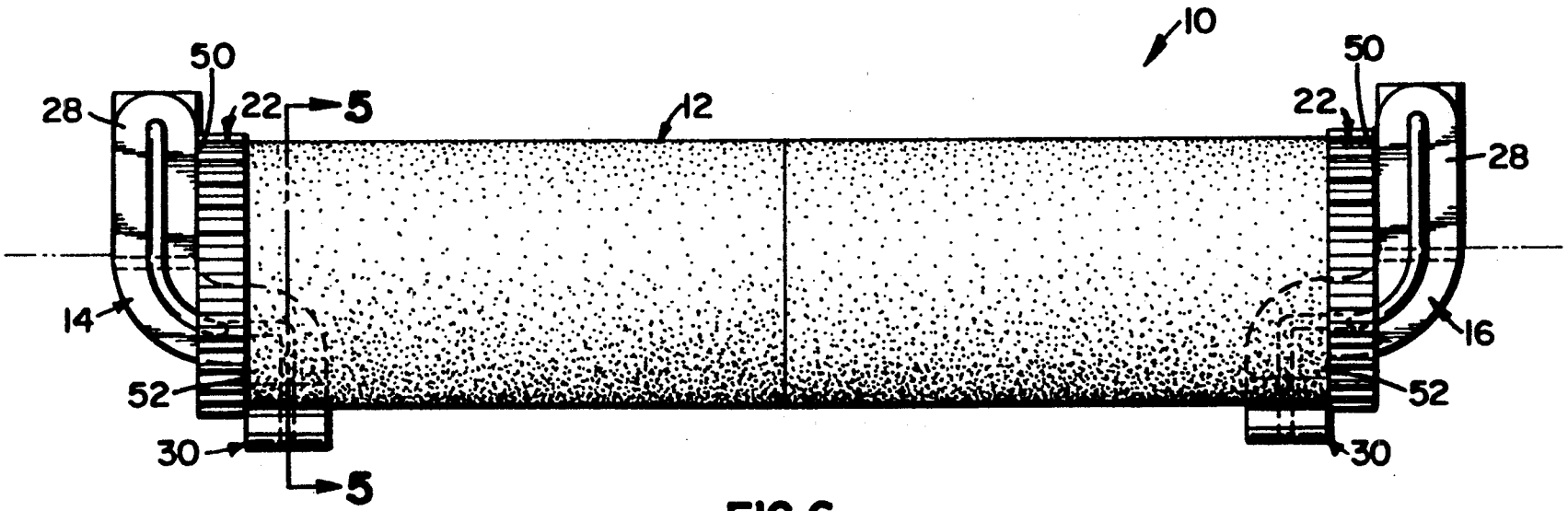
FIG. 6 shows a top view of the wrist rest support system including two extension clamps and a wrist rest.

FIG. 6 shows a top view of the wrist rest support system 10 including left hand extension clamp 14 and right hand extension clamp 16 and wrist rest 12. End cap 22 is shown placed between second side 50 of first end member 28 and first side 52 of second end member 30.

In use, the wrist rest support system is installed by the user first adjusting the height of wrist rest 12 relative to the working surface 24 and adjusting the length $L_2$ of a wrist rest 12. This is done in accordance with a method well known in the art and particularly described in U.S. Pat. No. 5,088,668.

Once the user has adjusted the height and length of wrist rest 12, clamps 14 and 16 can be fastened to working surface 24, as shown in FIG. 1. Left hand extension clamp 14 is attached to working surface 24 to the left of a user facing working surface 24. Right hand extension clamp 16 is fastened to working surface 24 to the right of the user. Clamps 14 and 16 are spaced apart on the working surface 24 so that the length $L_1$ between second sides 50 of first ends 28 is approximately equal to, but slightly greater than, the length $L_2$ of wrist rest 12 so that the distal ends 21 of end caps 22 will abut second sides 50.

Because the distance $W_2$ between second side 50 of first end member 28 and first side 52 of second end member 30 is approximately equal, but slightly greater than, the width $W_1$ of end cap 22, inner side 23 of end cap 22 will abut first side 52 of second end member 30. This arrangement, having the distal end of end cap 22 abutting second side 50 and the inner side of end cap 22 abutting first side 52, tends to stabilize the longitudinal position of wrist rest 12.

As shown in FIG. 5, the user should place sculpted portion 19 of base member 20 of wrist rest 12 in groove 44. By placing sculpted portion 19 in groove 44, engagement between sculpted portion 19 and groove 44 will tend to resist movement of wrist rest 12 in a direction perpendicular to the length of wrist rest 12. Although a particular wrist rest is shown in FIG. 5 having a sculpted portion 19, it is anticipated that the clamp 14 could be used with a different wrist rest, with a different portion of the wrist rest being received in a groove like the one shown or a groove having a different shape. Retaining member 46, in conjunction with groove 44, acts to prevent wrist rest 12 from sliding off the distal ends of second end members 30 of cantilever plates 26.

Clamps 14 and 16 are fastened to working surface 24 by unscrewing clamp screw 38 in accordance with a method well known in the art. The fastening means, including first end member 28, vertical member 32 and horizontal member 34, is then placed around working surface 24. Finally, screw 38 is adjusted to fasten clamp 14 to working surface 24, in accordance with the method well known in the art.

It is apparent that many modifications and variations of the invention as herein before set forth may be made without parting from spirit and scope thereof. The specific embodiments described are given by way of example only and the invention is limited only by the terms of the appended claims.

What is claimed is:

1. An wrist rest support system for attachment to a working surface, comprising:

a wrist rest having two oppositely disposed ends and a base member having a sculpted portion;

first and second extension clamps, each having a cantilever plate having a first end member proximate the working surface and a second end member having a distal end cantilevered away from the working surface and each end member has a separate approximately parallel longitudinal axis, the axis of the first end member being laterally spaced from the axis of the second end member, and the first end member having a first side and a second side oppositely disposed on either side of the longitudinal axis of the first end member; and fastening means, operably connected to the first end member of the cantilever plate, for attaching the cantilever plate to the working surface, wherein the two extension clamps can be fastened to the working surface, spaced apart so that the wrist rest can be placed between the second side of the first end member of the first clamp and the second side of the first end member of the second clamp with a first nd of the oppositely disposed ends of the wrist test being adjacent the second side of the first end member of the first clamp and a second end of the oppositely disposed ends of the wrist rest being adjacent the second side of the first end member of the second clamp.

2. The wrist rest support system in accordance with claim 1, wherein the second end of the cantilever plate has a groove for receiving the sculpted portion of the base member of the wrist rest, the groove being proximately perpendicular to the second axis.

3. The wrist rest support in accordance with claim 1, further comprising a retaining member disposed upwardly at the distal end of the second end member for retaining the wrist rest on the second end member.

4. A wrist rest support system for attachment to a working surface, comprising:

a wrist rest having two oppositely disposed ends and a base member;

first and second extension clamps, each having a cantilever plate having a first end member proximate the working surface and a second end member having a distal end cantilevered away from the working surface and each end member has a separate approximately parallel longitudinal axis, the axis of the first end member being laterally spaced from the axis of the second end member, and the first end member having a first side and a second side oppositely disposed on either side of the longitudinal axis of the first end member; and fastening means, operably connected to the first end member of the cantilever plate, for attaching the cantilever plate to the working surface, wherein the two extension clamps can be fastened to the working surface, spaced apart so that the wrist rest can be placed between the second side of the first end member of the first clamp and the second side of the first end member of the second clamp with a first end of the oppositely disposed ends of the wrist rest being adjacent the second side of the first end member of the first clamp and a second end of the oppositely disposed ends of the wrist rest being adjacent the second side of the first end member of the second clamp.

5. The wrist rest support in accordance with claim 4, further comprising a retaining member disposed upwardly at the distal end of the second end member for retaining the wrist rest on the second end member.

* * * * *